US005515834A

United States Patent [19]

Hoshino et al.

[11] Patent Number: 5,515,834

[45] Date of Patent: May 14, 1996

[54] AIR-FUEL RATIO CONTROL SYSTEM FOR AN INTERNAL COMBUSTION ENGINE

[75] Inventors: Shinichi Hoshino; Koji Okawa, both of Toyota, Japan

[73] Assignee: Toyota Jidosha Kabushiki Kaisha, Toyota, Japan

[21] Appl. No.: 502,028

[22] Filed: Jul. 13, 1995

Related U.S. Application Data

[63] Continuation of Ser. No. 250,074, May 27, 1994, abandoned.

[30] Foreign Application Priority Data

Jun. 4, 1993 [JP] Japan ..... 5-134910

[51] Int. Cl.[6] ..... F02D 41/14; F02M 25/08

[52] U.S. Cl. ..... 123/674; 123/691; 123/698

[58] Field of Search ..... 123/673, 674, 123/675, 691, 692, 698, 520

[56] References Cited

U.S. PATENT DOCUMENTS

| | | | |
|---|---|---|---|
| 3,913,545 | 10/1975 | Haase et al. | 123/520 |
| 4,130,095 | 12/1978 | Bowler et al. | 123/675 |
| 4,664,087 | 5/1987 | Hamburg | 123/520 |
| 4,748,959 | 6/1988 | Cook et al. | 123/520 |
| 4,951,637 | 8/1990 | Cook | 123/520 |
| 4,977,881 | 12/1990 | Abe et al. | 123/698 |
| 4,995,369 | 2/1991 | Cook | 123/520 |
| 5,027,780 | 7/1991 | Uranishi et al. | 123/520 |
| 5,048,492 | 12/1991 | Davenport et al. | 123/674 |
| 5,048,493 | 12/1991 | Orzel et al. | 123/696 |
| 5,131,372 | 7/1992 | Nakaniwa | 123/674 |
| 5,158,059 | 10/1992 | Kuroda | 123/691 |
| 5,226,398 | 7/1993 | Cook et al. | 123/520 |
| 5,228,421 | 7/1993 | Orzel | 123/339 |
| 5,245,978 | 9/1993 | Orzel | 123/674 |
| 5,257,613 | 11/1993 | Monda et al. | 123/674 |
| 5,263,460 | 11/1993 | Baxter et al. | 123/520 |
| 5,299,546 | 4/1994 | Kato et al. | 123/520 |
| 5,363,830 | 11/1994 | Morikawa | 123/674 |
| 5,368,002 | 11/1994 | Hoshino et al. | 123/674 |
| 5,400,761 | 3/1995 | Fukasawa et al. | 123/674 |
| 5,406,927 | 4/1995 | Kato et al. | 123/674 |
| 5,423,307 | 6/1995 | Okawa et al. | 123/698 |

FOREIGN PATENT DOCUMENTS

| | | |
|---|---|---|
| 2-19631 | 1/1990 | Japan . |
| 2-130240 | 5/1990 | Japan . |
| 2-241943 | 9/1990 | Japan . |
| 6-17716 | 1/1994 | Japan . |

*Primary Examiner*—Willis R. Wolfe, Jr.
*Attorney, Agent, or Firm*—Kenyon & Kenyon

[57] ABSTRACT

An air-fuel control system for an internal combustion engine is provided in which air-fuel ratio control system a deviation effect due to an amount of evaporated fuel distributed to each cylinder group differing from cylinder group to cylinder group is eliminated when a deviation of air-fuel ratio due to aging of the engine has been learned. A difference value between the air-fuel correction factor and a value of a range of distribution deviation of the air-fuel ratio is obtained so that the difference value is used as the air-fuel correction factor. The difference value is obtained when the engine is determined to be in a purging operation by the first determining means, and when it is determined that learning of the air-fuel ratio correction factor is not completed. The difference value represents a true deviation of the air-fuel ratio due to aging of the engine parts.

6 Claims, 5 Drawing Sheets

AIR-FUEL RATIO CONTROL SYSTEM FOR AN INTERNAL COMBUSTION ENGINE

This application is a continuation of application Ser. No. 08/250,074, filed May 27, 1994, now abandoned.

BACKGROUND OF THE INVENTION (1) Field of the Invention

The present invention relates to an air-fuel ratio control system for an internal combustion engine, and more particularly to an air-fuel ratio control system having an evaporated fuel purge system with a learning and controlling function.

(2) Description of the Related Art

An internal combustion engine is know in the art, which engine has a canister for temporarily storing evaporated fuel and an air-fuel ratio sensor provided in an exhaust line, and wherein an amount of injected fuel is corrected using a feedback correction factor (FAF) in accordance with an output signal from the air-fuel ratio sensor so that the air-fuel ratio is a predetermined target air-fuel ratio.

Additionally, in a case where a suction air amount is detected by means of a pressure in an intake line, a basic fuel-injection amount is determined in accordance with a rotating speed of the engine and an internal pressure of a surge tank measured by an intake pressure sensor. In such a case, it is necessary to correct a basic fuel-injection amount map because of degradation of characteristics of the sensors and actuators (for example, a fuel injector) due to aging. To overcome the degradation due to aging, a control system for determining the basic fuel-injection amount has a function to learn an effect resulting from the degradation due to aging. The effect may degrade the air-fuel controlling operation efficiency. In the control system, learning values are used for eliminating the effect resulting from the degradation due to aging. The learning values may be respectively provided for a plurality of engine condition ranges. These ranges may have been previously obtained by dividing all of the entire engine operating conditions into a plurality of operating condition ranges, which dividing is performed in accordance with the intake line pressures occurring during the operation of the engine. The learning values may be corrected by varying (updating) them according to the degradation of the characteristics in the engine due to aging. This correction of the learning values may be achieved using the variation (shifting) of the FAF from a reference value.

Japanese Laid-Open Patent Application No.6-17716 discloses the above-mentioned kind of air-fuel ratio control system. This system obtains a deviation of the air-fuel ratio by separating it into a deviation (purge deviation) due to a purge effect and a deviation (aging deviation) due to aging effect. The system learns only the aging deviation due to aging so as to apply it to the air-fuel control. This allows to obtain the learning values while performing a purge operation, and thus an accurate learning operation can be performed while maintaining a sufficient purge amount of fuel.

The above-mentioned air-fuel ratio control system is suitable for a four-cylinder engine in which purged evaporated-fuel is uniformly introduced to each cylinder, and is able to perform an accurate learning operation.

However, the above-mentioned air-fuel ratio control system is not suitable for an engine having a V banked cylinder structure, such as a 6-cylinder V type engine, in which cylinders are divided into two groups, for example, a first bank comprising the first, third and fifth cylinders and a second bank comprising the second, fourth and sixth cylinders. In this type of engine, an intake manifold is branched so that a fuel-air mixture is directed to each of the cylinder groups. Accordingly, evaporated fuel is separately purged to an intake line of each cylinder group. The purged amount of evaporated fuel may vary from one cylinder group to another cylinder group due to fluctuation in an intake air amount and fluctuation in an exhaust gas flow generated by an exhaust gas recirculation system (EGR)

For example, if an amount of evaporated fuel purged to the first bank increases, the amount of evaporated fuel purged to the second bank decreases. Accordingly, in this case, the state of the air-fuel ratio in the first bank becomes too rich, while that of the second bank becomes too lean. That is, in the engine having the V banked cylinder structure, improper distribution of evaporated fuel to be purged to the first and second banks also causes variation of the air-fuel ratio.

Accordingly, there is a problem in that the conventional air-fuel control system, if it is applied to the V type engine, may erroneously recognize and learn the above variation of the air-fuel ratio as being the aging variation.

SUMMARY OF THE INVENTION

It is a general object of the present invention to provide an improved and useful air-fuel ratio control system for an internal combustion engine in which system the above-mentioned disadvantages are eliminated.

A more specific object of the present invention is to provide an air-fuel control system for an internal combustion engine in which air-fuel ratio control system deviation effect due to an amount of evaporated fuel distributed to each cylinder group differing from cylinder group to cylinder group is eliminated when a deviation of an air-fuel ratio due to aging of the engine has been learned.

In order to achieve the above-mentioned objects, there is provided according to the present invention, an air-fuel ratio control system for an internal combustion engine having a plurality of cylinders, intake air being supplied separately to at least two cylinders or at least two groups of cylinders, the engine comprising an evaporated fuel purge system in which a purge ratio of evaporated fuel is varied, the air-fuel ratio control system comprising:

setting means for setting a fuel injection amount to be injected to the cylinders or the groups of cylinders;

controlling means for controlling the setting means using an air-fuel ratio correction factor so that air-fuel ratio is maintained to be a predetermined target air-fuel ratio, the air-fuel ratio correction factor being obtained in accordance with exhaust gas condition;

first determining means for determining whether or not purging of the evaporated fuel is being performed in the engine;

first learning means for learning the air-fuel ratio correction factor for each of the cylinders or each of the groups of cylinders, the air-fuel ratio correction factor being obtained for each of predetermined operating condition ranges of the engine;

second determining means for determining whether or not learning of the air-fuel ratio correction factor for each of the operating ranges is completed;

computing means for computing a range of a first deviation of the air-fuel ratio which deviation is generated due to a difference in distributing amount of intake air between the cylinders or between the groups of cylinders, the intake air being distributed in accordance with the purge ratio;

second learning means for obtaining a difference value between the air-fuel ratio correction factor and a value of the range of the first deviation of the air-fuel ratio so that the difference value is used as the air-fuel correction factor, the difference value being obtained when the engine is determined to be in purging operation by the first determining means, and when it is determined by said second determining means that learning of the air-fuel ratio correction factor by the first learning means is not completed; and reflecting means for reflecting the feedback correction factor obtained by the second learning means to the fuel injection amount set by the setting means.

According to the present invention, a learning value of a true deviation of the air-fuel ratio due to aging can be obtained by eliminating an amount of evaporated fuel purged to each cylinder or cylinder group. Therefore, learning of a proper air-fuel ratio can be improved, and thus an accurate air-fuel ratio control can be realized.

Other objects, features and advantages of the present invention will become more apparent from the following detailed descriptions when read in conjunction with the accompanying drawings.

DETAILED DESCRIPTION OF THE PREFERRED EMBODIMENT

Figure 1:
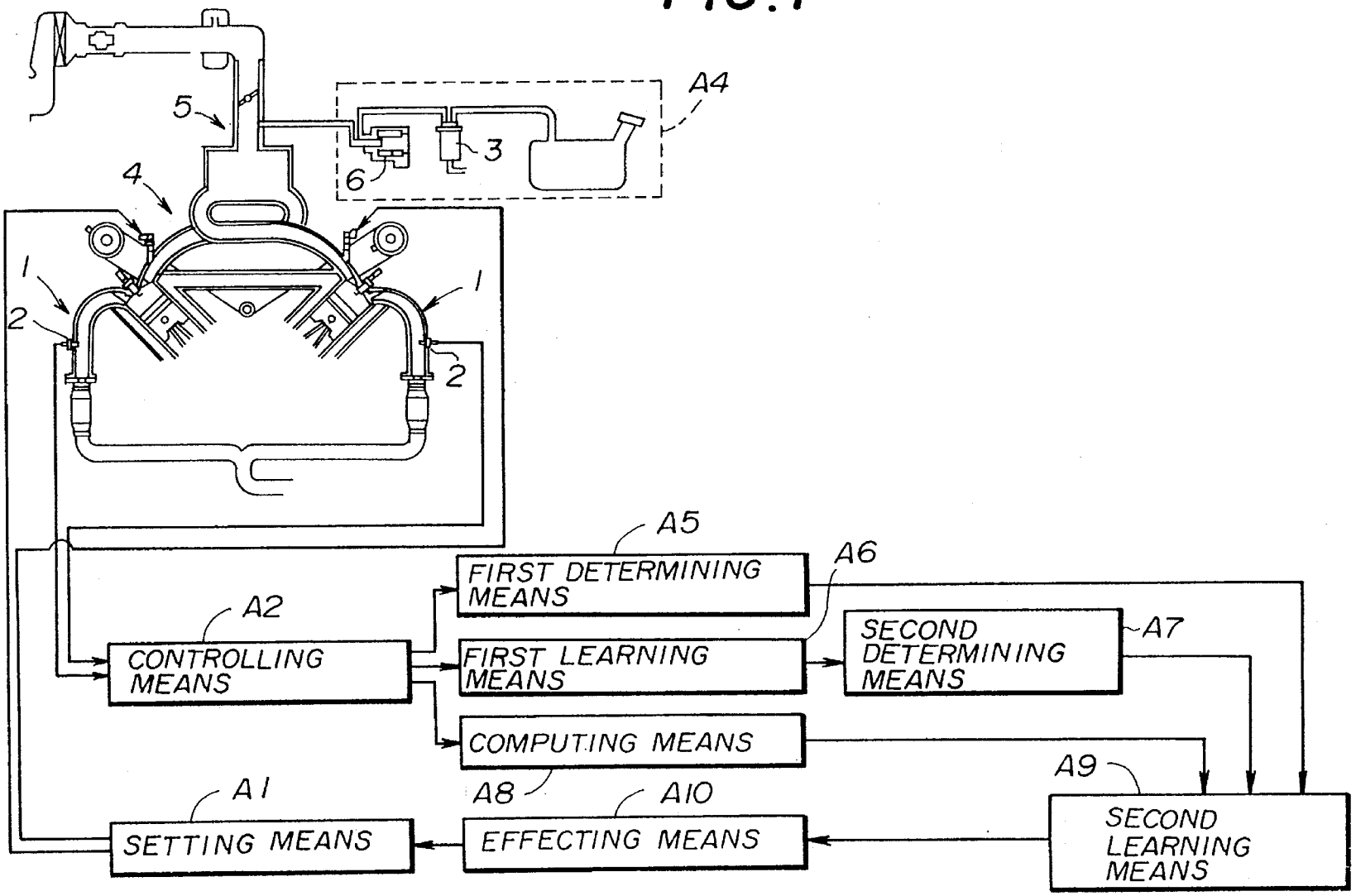
FIG. 1 is an illustration for explaining the principle of the present invention.

A description will now be given, with reference to FIG. 1, of the principle of the present invention. As shown in FIG. 1, an air-fuel ratio control system according to the present invention comprises: setting means A1 for setting a fuel injection amount; controlling means A2 for feedback controlling an air-fuel ratio; an evaporated fuel purge system A4; first determining means A5 for determining a purge operation; first learning means A6 for learning an air-fuel ratio correction factor; second determining means A7 for determining completion of learning; computing means A8 for computing deviation of air-fuel ratio; second learning means A9 for learning an air-fuel ratio correction factor when learning is not performed; and effecting means A10 for effecting the air-fuel ratio correction factor to adjust the fuel injection amount in accordance with the effected correction factor.

The air-fuel ratio control system is operated in association with an internal combustion engine having a evaporated fuel purge system A4. In the evaporated fuel purge system A4, a canister 3 stores evaporated fuel generated in a fuel tank and purges the evaporated fuel into an intake line 5 of the engine via purge ratio controlling means 6.

The setting means A1 is provided for setting a fuel injection amount to be injected to cylinders or groups of cylinders. The controlling means A2 controls the setting means using an air-fuel ratio correction factor so that air-fuel ratio is maintained to be a predetermined target air-fuel ratio. The air-fuel ratio correction factor is obtained by means of outputs from air-fuel ratio sensors 2 provided on exhaust lines of the engine.

The first determining means A5 is provided for determining whether or not purging of the evaporated fuel is being performed in the engine 1. The first learning means A6 is provided for learning the air-fuel ratio correction factor for each of the cylinders or each of the groups of cylinders. The air-fuel ratio correction factor is obtained for each of predetermined operating condition ranges of the engine.

The second determining means A7 determines whether or not learning of the air-fuel ratio correction factor for each of the operating ranges is completed. The computing means computes a range of the first deviation of the air-fuel ratio which deviation is generated due to an amount of intake air distributed to each of the cylinders or to each of the groups of cylinders differing from cylinder to cylinder or from cylinder group to cylinder group, the intake air being distributed in accordance with the purge ratio;

The second learning means A9 is provided for obtaining a difference value between the air-fuel correction factor and a value of the range of the first deviation so that the difference value is used as the air-fuel correction factor. The difference value is obtained when the engine is determined to be in a purging operation by the first determining means A5, and when it is determined by the second determined means A7 that learning of the air-fuel ratio correction factor by the first learning means is not completed. The effecting means A10 effects the feedback correction factor obtained by the second learning means to the fuel injection amount set by the setting means.

The air-fuel ratio deviation value obtained by the computing means A8 corresponds to a distribution ratio of the amount of evaporated fuel purged to each cylinder. That is, in the previously mentioned V type engine, there may occur an air-fuel deviation due to a difference between the amount of the evaporated fuel distributed to the first bank and that distributed to the second bank. Hereinafter, the air-fuel ratio deviation due to a difference in the amount of the evaporated fuel distributed is referred to as distribution deviation.

The distribution deviation of the air-fuel ratio is not the aging deviation which it is desired to learn. Accordingly, if a value including the distribution deviation value is learned, accuracy in learning is deteriorated, and thus an accurate air-fuel control cannot be performed.

In the above-mentioned air-fuel control system according to the present invention, a difference between the air-fuel correction factor and the distribution deviation value of the air-fuel ratio obtained by the computing means A8 is obtained by the second learning means A9, the difference being a true air-fuel correction factor. Therefore, learning of a proper air-fuel ratio can be improved, and thus an accurate air-fuel ratio control can be realized.

Figure 2:
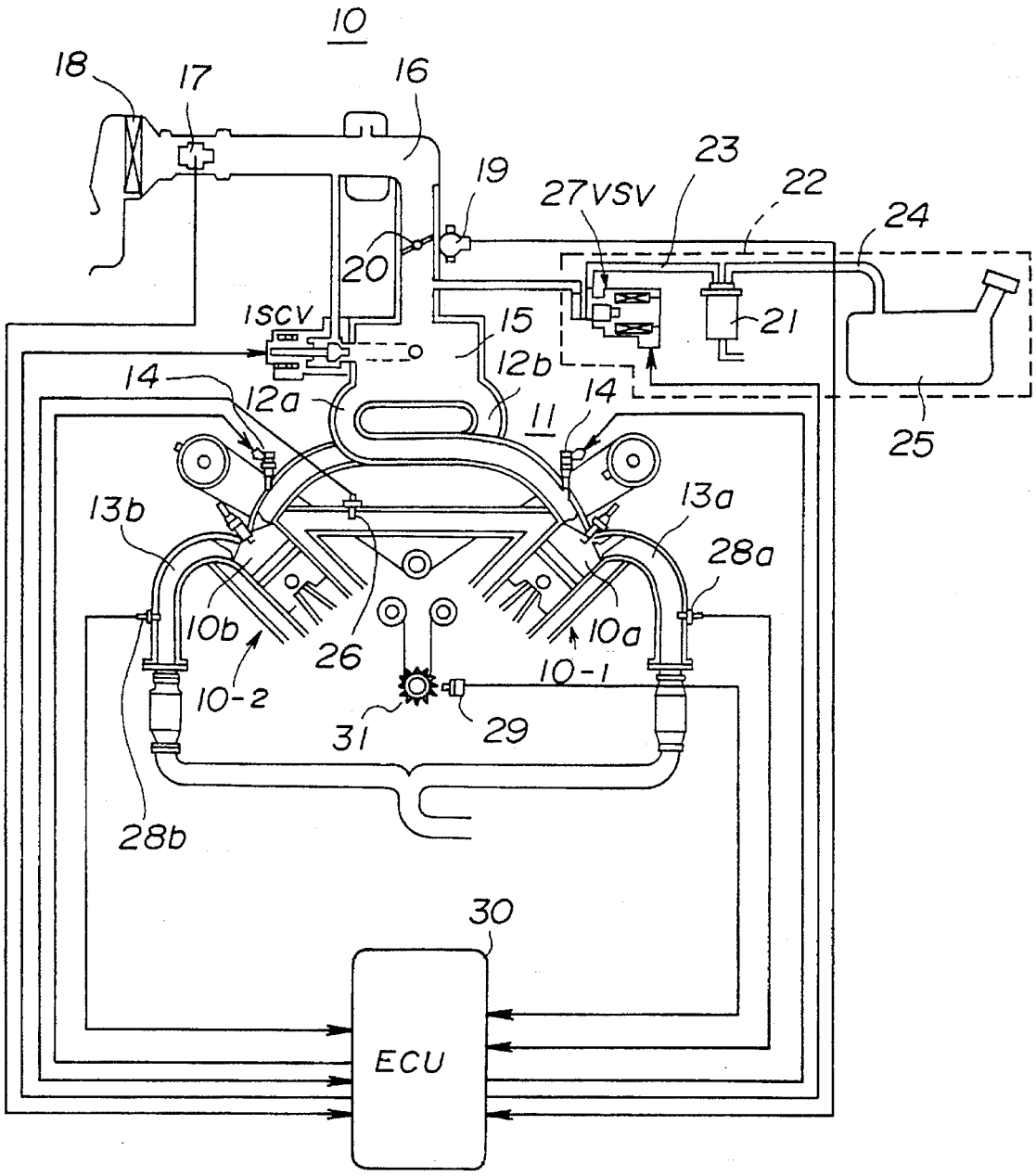
FIG. 2 is an illustration of an engine to which an embodiment of an air-fuel ratio control system according to the present invention is applied.

A description will now be given, with reference to FIG. 2, of an embodiment of an air-fuel ratio control system according to the present invention. FIG. 2 is an illustration of an engine to which an embodiment of an air-fuel ratio control system according to the present invention is applied. The engine 10 shown in FIG. 2 is a 6-cylinder V type engine having a first group of cylinders comprising the first, third and fifth cylinders and a second group of cylinders comprising the second, fourth and sixth cylinders. The first group of cylinders is referred to as a first bank $10_{-1}$, and the second group of cylinders is referred to as a second bank $10_{-2}$. It should be noted that, for the sake of convenience, only a first cylinder 10*a* and a second cylinder 10*b* are shown in the figure.

The engine 10 further comprises an engine body 11, intake manifolds 12*a* and 12*b*, exhaust manifolds 13*a* and 13*b*, and fuel injection valves 14 mounted on the intake manifolds 12*a* and 12*b*, respectively. The manifolds 12*a* and 12*b* are connected to a common surge tank 15. The surge tank 15 is connected to an air cleaner 18 via an intake duct 16.

In the engine 10, intake air is induced independently to the first bank $10_{-1}$ and the second bank $10_{-2}$ via the two manifolds 12*a* and 12*b*. A throttle position sensor 19 is provided on the intake duct 16, while an air flow meter 17 for measuring suction air flow and a throttle valve 20 which opens and closes the intake duct 16 in association with an operation of an acceleration pedal are provided in the intake duct 16. An opening angle of the throttle valve 20 is detected by the throttle position sensor 19.

Additionally, the engine 10 comprises an evaporated fuel purge system 22 which includes a canister 21 containing activated carbon. The canister has a fuel vapor chamber and an atmosphere chamber (both not shown in the figure) on respective sides of a portion holding the activated carbon. The fuel vapor chamber is connected at one end to a fuel tank 25 via a pipe 24, and connected at the other end to the intake duct 16 via a pipe 23. The pipe 23 is connected to the intake duct 16 at a position downstream of the throttle valve 20. A purge control valve (VSV) 27 controlled by an electronic control unit (ECU) 30 is provided on the pipe 23 between the intake duct 16 and the canister 21.

The evaporated fuel generated in the fuel tank 25 enters into the canister 21 via the pipe 24, and adsorbed in the activated carbon. When the purge valve 27 opens, atmospheric air is introduced into the pipe 23 via the atmosphere chamber and activated carbon in the canister 21. When the air passes through the activated carbon, the evaporated fuel adsorbed in the activated carbon is released from the activated carbon, and the air containing the evaporated fuel is purged into the intake duct 16 via the pipe 23.

The ECU 30, which is a digital computer in this embodiment, comprises a ROM, a RAM, a CPU, a back-up RAM, an input port and an output port. The air flow meter 17 in the intake duct 16 measures an air flow in the intake duct 16, and a output signal from the meter 17 is input to the input port of the ECU 30 via an A/D converter. An output signal of the throttle position sensor 19 is also input to the ECU 30. Additionally, the engine body 11 is provided with a water temperature sensor 26 which generates an output voltage proportional a water cooling temperature. The output voltage of the water temperature sensor 26 is also supplied to the ECU 30.

The exhaust manifolds 13*a* and 13*b* are provided with air-fuel ratio sensors ($O_2$ sensors) 28*a* and 28*b*, respectively. Output signals of the $O_2$ sensors 28*a* and 28*b* are also supplied to the ECU 30. Further, a crank angle sensor 29 generating an output pulse signal each time when a crank shaft 31 is rotated to a predetermined angle is connected to the ECU 30. The ECU 30 computes a rotation speed of the engine in accordance with the output pulse signal from the crank angle sensor 29. The output port of the ECU 30 is connected to the fuel injection valve 14 and the purge control valve 27 via a respective drive circuit.

The means A1 through A10 comprising the air-fuel control system according to the present invention are included in a software program executed by the ECU 30. A description will be given later of an air-fuel ratio control process and a learning process executed by the ECU 30.

Prior to the description of the above processes, a description will first be given of the different kinds of air-fuel ratio deviations. Hereinafter, the air-fuel ratio deviation refers to a value deviating from the stoichiometric condition (FAF=1) of the feedback correction factor FAF computed by the means A2 for feedback controlling the air-fuel ratio.

The air-fuel deviation in the engine 10 is generally classified into two kinds according to its generation mode. One kind is a deviation resulting from degradation of sensors and actuators. This deviation is referred to as aging deviation. In order to perform an accurate air-fuel control, the aging deviation must be measured, and the measured deviation should be effected to the air-fuel ratio control by having the measured deviation absorbed in a basic learning value KG. KG will be described in detail later.

The other kind of the air-fuel ratio deviation is caused by the evaporated fuel purged by the evaporated fuel purge system 22. This deviation is referred to as purge deviation. The purge deviation varies according to the amount of evaporated fuel purged by the evaporated fuel purge system 22. In order to perform an accurate air-fuel control, the purge deviation must be measured, and the measured deviation should be effected to the air-fuel ratio control by having the measured deviation absorbed in a purge learning value FGPGR. FGPGR will be described in detail later.

Additionally, in the engine 10 having the two banks $10_{-1}$ and $10_{-2}$, since the two intake manifolds 12*a* and 12*b* are connected to the surge tank 15 to introduce intake air to the respective banks $10_{-1}$ and $10_{-2}$, the distribution ratio of intake air for one bank may not be equal to that of the other bank. However, even in such a case, it is necessary to perform a proper air-fuel ratio control.

A description will now be given, with reference to FIGS.3 through 5, of a learning process performed by the electronic control unit (ECU) 30. In the learning process, the basic learning value KG and the purge learning value FGPGR are obtained by computation. KG is a value to be used for effecting the degradation of characteristics of the engine 10 to the air-fuel ratio control. FGPGR is a value to be used for effecting the variation of the air-fuel ratio due to the purging of evaporated fuel to the air-fuel ratio control.

Figure 3:
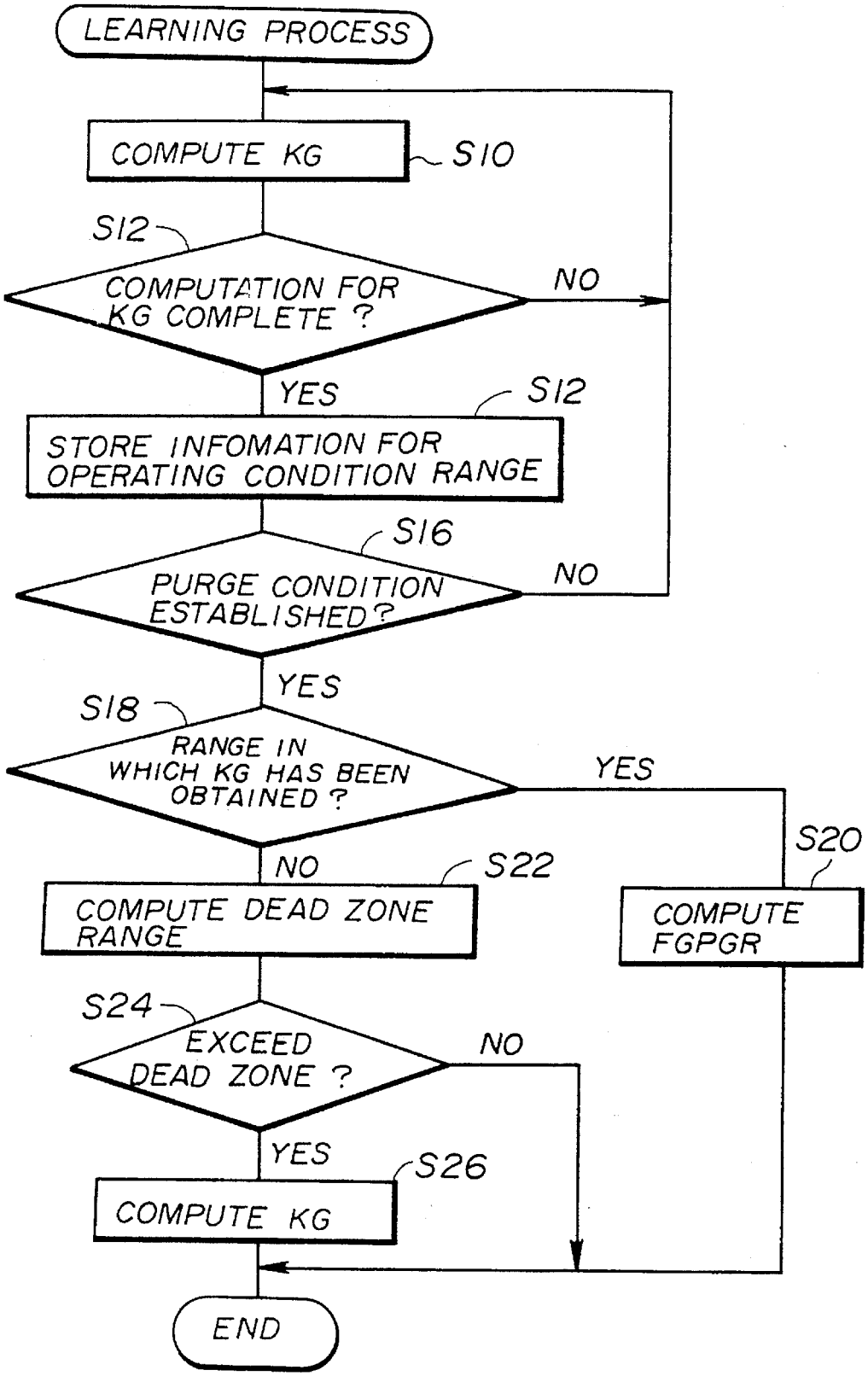
FIG. 3 is a flow chart of a learning operation performed in the embodiment shown in FIG. 2.

FIG. 3 shows a flow chart of the learning process for obtaining the basic learning value KG and the purge learning value FGPGR.

When the learning process is started, first, in step 10 (in the drawings, "step" is abbreviated as "S"), the basic learning value KG is computed. Since KG also varies according to the operating conditions of the engine 10, KG is respectively obtained for each operating condition range of the engine. In the present embodiment, the operating conditions of the engine 10 are classified into operating condition ranges according to the amount of the intake air. Accordingly, the computation of the basic learning value KG in step 10 is performed for each operating condition range of the engine 10.

In step 12, it is determined whether or not the computation of the basic learning value KG is completed. If not, execution of step 10 is continued. If yes in step 12, the routine proceeds to step 14 where the basic learning value KG and information for the operating condition range for which KG is obtained are stored in a predetermined area of the memory. In the following step 16, it is determined whether or not the purge condition is established. If the purge condition is not established, the routine returns to step 10 to repeat the process of step 10 through step 16. It should be noted that the operation of the engine 10, while the process of step 10 through step 16 is performed, is in a condition where the purging of the evaporated fuel from the evaporated fuel purge system 22 is not performed. Accordingly, the basic learning value KG obtained while performing the process of step 10 through step 16 corresponds only to the aging deviation mentioned above.

On the other hand, if it is determined, in step 16, that the purge condition is established, the ECU 30 sends a signal to open the VSV 27, and thereby the evaporated fuel in the canister 21 is purged into the intake duct 16 via the pipe 23. After the purging has started, the ECU 30 determines, in step 18, whether or not the current operating condition range corresponds to the operating condition range for which the basic learning value KG has been obtained in the process of step 10 through step 16. The determination is performed in accordance with an intake air amount signal supplied by the air flow meter 17.

If it is determined, in step 18, that the current operating condition range corresponds to the operating condition range for which the basic learning value KG has been learned, the routine proceeds to step 20 where the purge learning value FGPGR is obtained by computation. FGPGR is a value corresponding to the feedback correction factor FAF in which the above-mentioned purge deviation has been absorbed. The feedback correction factor FAF is obtained in accordance with the difference between the target fuel injection amount and the fuel amount actually injected. By effecting the purge learning value FGPGR to the air-fuel ratio control, the air-fuel ratio can be controlled in a stoichiometric condition.

Since, by the time the routine proceeds to step 20, the basic learning value KG has already been learned, both the aging deviation and the purge deviation have been learned.

The purge learning value is obtained by the following equation.

$$FGPGR=FGPGR_0+(FAF-1.0)/PGR$$

Where:

FGPGR is a purge learning value currently obtained;

$FGPGR_0$ is a purge learning value obtained last time;

FAF is a feedback correction factor; and

PGR is a purge ratio.

On the other hand, if it is determined, in step 18, that the current operating condition range corresponds to an operating condition range for which the basic learning value KG has not been obtained, the routine proceeds to step 22 where a range of a dead zone is obtained. The dead zone is a range in which the air-fuel ratio deviates due to purging of the evaporated fuel from the evaporated fuel purge system 22. Particularly, in the engine 10 having the two banks $10\text{-}_1$ and $10\text{-}_2$, since the amount of intake air distributed to the bank $10\text{-}_1$ differs from that distributed to the bank $10\text{-}_2$, an amount of evaporated fuel purged to the bank $10\text{-}_1$ is not equal to that purged to the bank $10\text{-}_2$. In the present embodiment, the deviation caused by this difference in distribution is defined as a dead zone.

The deviation of the air-fuel ratio, obtained when the determination in step 18 is negative, will now be discussed. The operation of the engine 10, when the process of step 18 is performed, is in the condition where purging of the evaporated fuel from the evaporated fuel purge system 22 is performed, and accordingly the purge deviation is generated. Additionally, at this time the aging deviation may also be generated. In such a case, the deviation of the air-fuel ratio, obtained when the determination of step 18 is negative, is a value which is a sum of the aging deviation and the purge deviation.

The reason for the negative determination in step 18 is that the basic learning value KG has not absorbed the aging deviation. In order to perform an accurate air-fuel control, the basic learning value KG to which degradation of characteristics of the engine 10 must be obtained first. A deviation (DEFAF) obtained, when the determination in step 18 is negative, is a sum of the aging deviation (TIFAF) and the purge deviation (PAFAF), that is DEFAF=TIFAF+PAFAF. As mentioned above, in the present embodiment applied to the engine 10 having the two banks $10\text{-}_1$ and $10\text{-}_2$, the purge deviation PAFAF in each bank is substantially equal to a range of the dead zone. It should be noted that in the engine 10 having the two banks $10\text{-}_1$ and $10\text{-}_2$, the air-fuel ratio control is separately performed for each bank.

A description will now be given, with reference to FIGS. 4 and 5, of a method for obtaining the range of the dead zone equal to the purge deviation PAFAF. In the graph shown in FIG. 4, the horizontal axis represents the purge ratio PGR, and the vertical axis represents a deviation value of the air-fuel ratio. In FIG. 4, relationships between the purge ratio and the deviation of the air-fuel ratio corresponding to three operating condition ranges are shown. These ranges are defined in accordance with variations in the amount of intake air. Other factors representing the operating condition of the engine may be used for defining these ranges. The three ranges are designated as a range 0 (KGAREA0), a range 1 (KGAREA1) and a range 2 (KGAREA2), respectively.

Relationships between the purge ratio and the deviation of the air-fuel ratio in each of the three ranges are shown by lines KGAREA0, KGAREA1 and KGAREA2, the relationships being obtained in a state where the evaporated fuel is purged uniformly to each of the banks $10\text{-}_1$ and $10\text{-}_2$. As mentioned above, the distribution ratio of the evaporated fuel varies, and the range of the variation can be obtained by experiments performed beforehand. Supposing the purge ratio varies PGR as the distribution ratio varies from one bank to another bank, the range of each dead zone PAFAF is defined as a range defined between intersections of each relationship lines and the minimum and maximum line of PGR. That is, PAFAF corresponding to the range 0 (KGAREA0) is the range indicated by c, that of the range 1 (KGAREA1) is b, and that of the range 2 (KGAREA2) is a.

Figure 4:
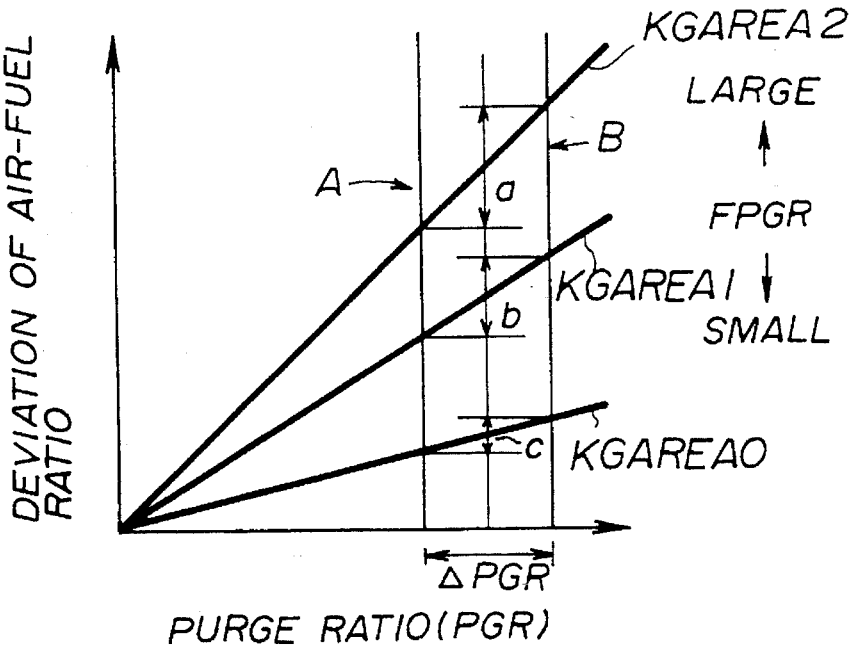
FIG. 4 is a graph showing a method for calculating a dead zone.

The purge learning reflecting value FPGR shown in FIG. 4 represents an amount of fuel (gasoline) contained per unit volume of the purged gas. Accordingly, FPGR can be obtained in accordance with the purge learning value FGPRG and the purge ratio PGR. Additionally, deviation (a, b and c in FIG. 4) due to effects of the distribution ratio is obtained in accordance with the variation of the PGR. FIG. 5 shows a relationship between the range of the dead zone and the purge learning reflecting value FPGR. This map is stored in the ROM of the ECU 30.

Returning again to FIG. 3, the learning process will be further described.

The purge learning reflecting value FPGR is obtained by the following equation.

$$FPGR=(1-FGPGR)\times PGR$$

Where:

FGPGR is a purge learning value; and

PGR is a purge ratio.

Figure 5:
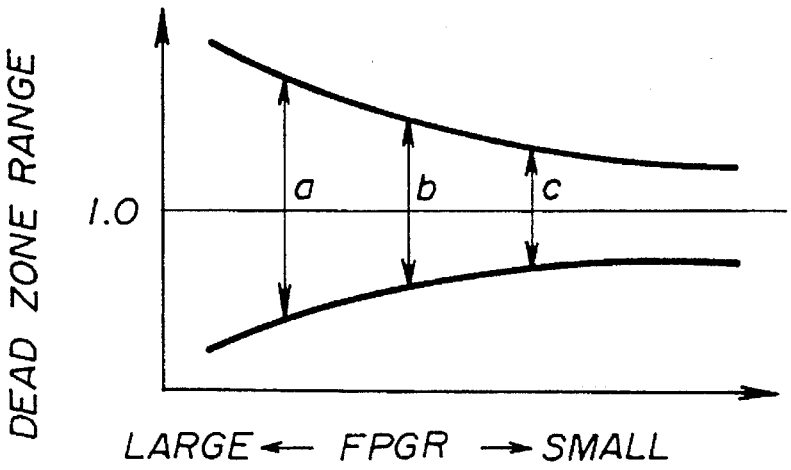
FIG. 5 is a graph showing a map for obtaining the dead zone from a purge learning reflecting value.

In step 22, the purge learning reflecting value is obtained using the above equation, and then the range of the dead zone is obtained in accordance with the obtained FPGR, with reference to the above-mentioned map shown in FIG. 5.

After the range of the dead zone PAFAF is obtained, in step 22, by computation, it is determined, in step 24, whether or not the current feedback correction factor FAF is greater than the range of the dead zone PAFAF. If yes in step 24, the aging deviation which has not been absorbed in the basic learning value KG occurs. Thus, if a positive determination is made in step 24, an aging deviation amount TIFAF is obtained, in step 26, by subtracting the range of the dead zone PAFAF from the deviation DEFAF of the air-fuel ratio (TIFAF=DEFAF−PAFAF). The basic learning value KG is obtained by computation so that the aging deviation amount TIFAF is absorbed.

On the other hand, if it is determined, in step 24, that the current feedback correction factor FAF is smaller than the width of the dead zone PAFAF, there is no aging deviation, and thus the routine ends without obtaining the basic learning value KG. The basic learning value KG and the purge learning value obtained in the above-mentioned learning process are effected to a basic fuel injection amount TP so as to obtain the fuel injection amount TAU by the following equation.

$$TAU=TP*[FAF+(KG-1.0)+(FGPRG-1.0)*PGR]$$

Where:

TAU is a fuel injection amount;

TP is a basic fuel injection amount;

FAFA is a feedback correction factor;

KG is a basic learning value;

FGPRG is a purge learning value; and

PGR is a purge ratio.

Figure 6:
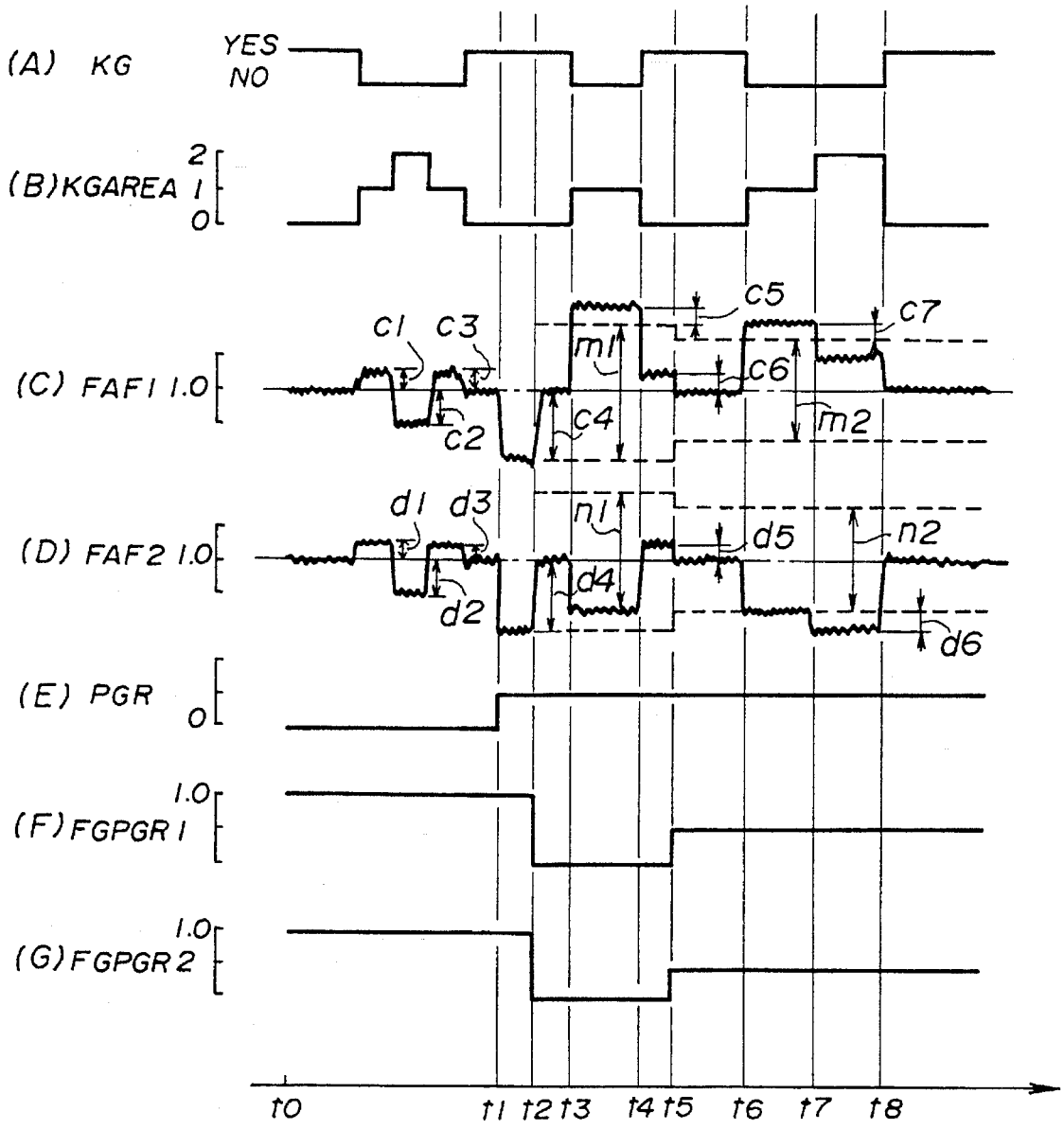
FIG. 6 is a timing chart showing an example of an operating condition of the engine shown in FIG. 2.

A further description will now be given, with reference to FIG. 6, of the learning process described with reference to FIG. 3. FIG. 6 shows a timing chart showing an example of the operating condition of the engine 10.

FIG. 6-(A) shows whether or not the basic learning value KG corresponds to the range for which KG has obtained. YES of FIG. 6-(A) means that KG has been obtained, and the aging deviation TIFAF has not been absorbed. FIG. 6-(B) shows three ranges KGAREA0-KGAREA2. FIG. 6-(C) and FIG. 6-(D) show feedback correction factors FAF1 and FAF2, respectively. FAF1 is provided for the bank 10-$_1$ of the engine 10 and FAF2 for the bank 10-$_2$. FIG. 6-(E) shows the purge ratio. FIG. 6-(F) and FIG. 6-(G) show purge learning values FGPGR1 and FGPGR2, respectively. FGPGR1 is provided for the bank 10-$_1$ of the engine 10 and FGPGR2 for the bank 10-$_2$.

In FIG. 6, it is assumed that the purge condition is established at time $t_1$, and that purging of the evaporated fuel is then started. That is, purging is not performed in the period from $t_0$ to $t_1$. The learning process performed in the period from $t_0$ to $t_1$ corresponds to the process performed in the steps 10 through 16 of FIG. 3. The deviation amount (indicated by c1–c3 and d1–d3) of the air-fuel ratio is regarded as the aging deviation amount TIFAF because no purging is performed. The basic learning value KG is computed in accordance with the aging deviation amount TIFAF (c1–c3, d1–d3), this process corresponding to the process in step 10 of FIG. 3. It should be noted that since no purging is performed in the period from $t_0$ to $t_1$, the purge ratio PGR is 0 and the purge learning values FGPGR1 and FGPGR2 are set to a basic value (=1).

When the purge condition is established at the time $t_1$, and purging is then started, the purge ratio PGR becomes a predetermined value. In the period from $t_1$ to $t_2$, as shown by FIG. 6-(A), the basic learning value KG has already been computed, and thus the aging deviation amount TIFAF has been absorbed in the basic learning value KG. Accordingly, the deviation amount generated in this period is only the purge deviation amount PAFAF (indicated by c4 and c5 in the figure) due to purging of the evaporated fuel.

In the above-mentioned operating condition of the engine, the determination in step 18 of FIG. 3 is positive, and thus the purge learning value FGPGR is computed in step 20. This FGPGR is effected, as mentioned above, to the computation of the fuel injection amount TAU. Thereby, the feedback correction factors FAF1 and FAF2 are controlled to be substantially equal to the basic value (=1) in the period from $t_2$ to $t_3$. Additionally, since the purge learning value is computed in step 20, FGPGR1 and FGPGR2 are changed as shown in FIG. 6-(F) and FIG. 6-(G).

In the following period from $t_3$ to $t_4$, the basic learning value has not been obtained, and purging is performed, which condition corresponds to the condition where the determination of step 18 of FIG. 3 is negative, and thus the width of the dead zone PAFAF is computed. Supposing that the ranges of the dead zone PAFAF obtained in step 22 fall in the ranges indicated by $m_1$ and $n_1$ in FIG. 6-(C) and FIG. 6-(D), respectively, the feedback correction value FAF1 exceeds the range of the dead zone PAFAF by cl indicated in FIG. 6(C), while the feedback correction value FAF2 exceeds this range by d1 indicated in FIG. 6 (D).

It is understood that The portion of the deviation amount of the air-fuel ratio indicated by c5 is generated due to the aging deviation, that is, this portion corresponds to the aging deviation amount TIFAF (TIFAF=c5). Therefore, in the period from $t_3$ to $t_4$, the determination in step 24 of FIG. 3 is positive, and thus the basic learning value KG is computed, in step 26, in accordance with the aging deviation amount TIFAF=c5. Accordingly, the basic learning value KG computed in step 26 is a value which absorbed the aging deviation amount TIFAF.

As mentioned above, in the period from $t_3$ to $t_4$, since the basic learning value KG is obtained in accordance with an amount which exceeds the dead zone, only the aging deviation can be obtained even if the operation of the engine is in the purging condition. Therefore, an accurate basic learning value KG can be obtained, and thus an accurate air-fuel ratio control can be realized.

It should be noted that a similar operation is performed after $t_4$ in FIG. 6. In the period from $t_4$ to $t_5$, the deviation amount indicated by c6 and c5 is absorbed in the purge learning value FGPGR. The deviation amount c7, which exceeds the dead zone $m_2$, is absorbed in the period from $t_6$ to $t_7$ in the basic learning value KG. The deviation amount d6, which exceeds the dead zone $n_2$, is absorbed in the period from $t_7$ to $t_8$ in the basic learning value KG.

The present invention is not limited to the specifically disclosed embodiment, and variations and modifications may be made without departing from the scope of the invention.

What is claimed is:

1. An air-fuel ratio control system for an internal combustion engine having a plurality of cylinders, intake air being supplied separately to at least two cylinders or at least two groups of cylinders, said engine comprising an evaporated fuel purge system in which a purge ratio of evaporated fuel is varied, said air-fuel ratio control system comprising:

setting means for setting a fuel injection amount to be injected to said cylinders or said groups of cylinders;

controlling means for controlling said setting means using an air-fuel ratio correction factor so that air-fuel ratio is maintained to be a predetermined target air-fuel ratio, said air-fuel ratio correction factor being obtained in accordance with an exhaust gas condition;

first determining means for determining whether or not purging of the evaporated fuel is being performed in said engine;

first learning means for learning the air-fuel ratio correction factor for each of the cylinders or each of the groups of cylinders, the air-fuel ratio correction factor being obtained for each of predetermined operating condition ranges of said engine;

second determining means for determining whether or not learning of the air-fuel ratio correction factor for each of the operating ranges is completed;

computing means for computing a range of a first deviation of the air-fuel ratio, which deviation is generated due to an amount of intake air distributed to each of said cylinders or to each of said groups of cylinders differing from cylinder to cylinder or from cylinder group to cylinder group, the intake air being distributed in accordance with said purge ratio;

second learning means for obtaining a difference value between said air-fuel ratio correction factor and a value of said range of the first deviation of the air-fuel ratio so that said difference value is used as the air-fuel correction factor, said difference value being obtained when said engine is determined to be in a purging operation by said first determining means, and when it is determined by said second determining means that learning of the air-fuel ratio correction factor by said first learning means is not completed; and effecting means for effecting said feedback correction factor obtained by said second learning means to adjust the fuel injection amount set by said setting means in accordance with the effected correction factor.

2. The air-fuel ratio control system as claimed in claim 1, wherein said first learning means comprises dividing means for dividing an operating condition of said engine into a plurality of operating condition ranges in accordance with an amount of intake air.

3. The air-fuel ratio control system as claimed in claim 2, wherein three operating condition ranges are defined by said dividing means, said first learning means learning said air-fuel correction factor for each of said three operating condition ranges.

4. The air-fuel ratio control system as claimed in claim 1, wherein said range of the first deviation of the air-fuel ratio is obtained in accordance with a relationship between the purge ratio and a second deviation of the air-fuel ratio generated due to a ratio of intake air distributed to each of said cylinders or to each of said groups of cylinders differing from cylinder to cylinder or from cylinder group to cylinder group, said relationship being obtained for each of said operating condition ranges.

5. The air-fuel ratio control system as claimed in claim 4, wherein said range of the first deviation of the air-fuel ratio is defined to be a range of variation of said second deviation of the air-fuel ratio within a predetermined range of the purge ratio.

6. The air-fuel ratio control system as claimed in claim 5, wherein said range of the first deviation is obtained by means of a map obtained according to said relationship between the purge ratio and the second deviation of the air-fuel ratio generated due to a ratio of intake air distributed to each of said cylinders or to each of said groups of cylinders differing from cylinder to cylinder or from cylinder group to cylinder group.

* * * * *

UNITED STATES PATENT AND TRADEMARK OFFICE

CERTIFICATE OF CORRECTION

PATENT NO. : 5,515,834

DATED : May 14, 1996

INVENTOR(S) : Shinichi HOSHINO, et al.

It is certified that error appears in the above-indentified patent and that said Letters Patent is hereby corrected as shown below:

Column 1, line 16, change "know" to --known--.

Column 3, line 65, change "a evaporated" to --an evaporated--.

Column 4, line 33, change "determined" at end of line to --determining--.

Column 5, line 51, change "a output" to --an output--.

Column 8, line 13, after "engine 10" insert --is added--.

Column 8, line 45, change "varies PGR" to --PGR varies--

Column 8, line 48, change "lines" to --line--.

Column 10, line 35, change "The portion" to --the portion--.

UNITED STATES PATENT AND TRADEMARK OFFICE

CERTIFICATE OF CORRECTION

PATENT NO. : 5,515,834

DATED : May 14, 1996

INVENTOR(S) : Shinichi HOSHINO, et al.

It is certified that error appears in the above-indentified patent and that said Letters Patent is hereby corrected as shown below:

Column 11, line 7, between "that" and "air-fuel" insert --the--.

Signed and Sealed this

Twenty-second Day of October, 1996

Bruce Lehman

*Attest:*

BRUCE LEHMAN

*Attesting Officer*

*Commissioner of Patents and Trademarks*